United States Patent [19]

Lenox et al.

[11] 4,343,923

[45] Aug. 10, 1982

[54] PROCESS FOR REDUCING THE ACID DYE UPTAKE OF POLYAMIDE TEXTILE MATERIALS WITH N-ACYLIMIDAZOLE COMPOUND

[75] Inventors: Ronald S. Lenox, Lancaster; Anne L. Schwartz, Columbia, both of Pa.

[73] Assignee: Armstrong World Industries, Inc., Lancaster, Pa.

[21] Appl. No.: 176,017

[22] Filed: Aug. 7, 1980

[51] Int. Cl.[3] ..... C08G 69/48

[52] U.S. Cl. ..... 525/426; 8/115.5; 8/DIG. 21; 525/420; 525/432

[58] Field of Search ..... 525/420, 426, 432; 8/115.5, DIG. 21

[56] References Cited

U.S. PATENT DOCUMENTS

| | | | |
|---|---|---|---|
| 2,952,506 | 9/1960 | Dellis | 8/516 |
| 3,454,351 | 7/1969 | Perry | 525/420 |
| 3,743,477 | 7/1973 | Egli et al. | 8/516 |

*Primary Examiner*—Harold D. Anderson

[57] ABSTRACT

A method for decreasing a polyamide textile material's affinity for acid dyes, which comprises pretreating the textile material with an acylimidazole compound.

19 Claims, No Drawings

PROCESS FOR REDUCING THE ACID DYE UPTAKE OF POLYAMIDE TEXTILE MATERIALS WITH N-ACYLIMIDAZOLE COMPOUND

BACKGROUND OF THE INVENTION

Polyamide textile materials, in particular nylon fibers and yarns, are of great value in the textile industry. Many such commercially available polyamide textile materials are receptive to acid, or anionic dyes. Other commercially available polyamide textile materials show limited or no receptivity to anionic dyes. A manufacturer who utilizes both types of textile materials would at times, depending on his production demands, find it advantageous to be able to convert rapidly an anionic dyeable textile material to a non- or limited anionically dyeable textile material without causing degradation of the textile material and therefore be able to use one polyamide textile material for a number of purposes. Thus, it is desirable to have a rapid, non-degradative method of decreasing an acid-dyeable polyamide textile material's affinity for acid dyes.

SUMMARY OF THE INVENTION

According to the invention, there is provided a process for pretreating polyamide textile materials which normally are susceptible to acid or anionic dyes to thereby provide the polyamide materials with improved resistance to acid dyes without substantially lowering the materials's break strength. The pretreating process of the present invention comprises reacting said polyamide textile materials with a acylimidazole compound of the formula I:

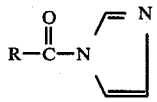

wherein R represents alkyl, haloalkyl, aryl, cycloalkyl, alkynyl, alkenyl, or a heterocyclic radical. For convenience, the acylimidazole compounds of formula I above are alternatively referred to herein as "Compound(s)."

DETAILED DESCRIPTION OF THE INVENTION

The polyamide textile materials which are normally susceptible to acid dyes and which have free amine ends and which are treated according to the process of the present invention comprise fabrics, fibers, filaments, yarns, pellicles, flocks and the like which are produced from a linear polyamide containing recurring units of the formula:

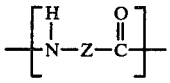

wherein Z is a member of the class consisting of a divalent hydrocarbon radical containing from 1 to about 20 carbon atoms and a divalent radical of the formula:

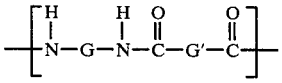

wherein G and G' are divalent hydrocarbon radicals independently containing from 1 to about 20 carbon atoms. Particularly suitable textile materials include nylon polymers such as nylon 66, a condensation product of adipic acid and hexamethylenediamine; nylon 6, a polymer of caprolactam; nylon 4, which is based on butyrolactam (2-pyrolidone); and nylon 610, which is obtained by condensation of sebacic acid and hexamethylenediamine.

In accordance with this invention a polyamide textile material is pretreated by being reacted with at least one of the compounds of formula I above. The reaction may take place neat, that is, in the absence of a solvent, or a suitable solvent for the compound(s) may be employed.

At the conclusion of this pretreating operation the polyamide textile materials may be, at the option of the practitioner of the invention, solvent washed to remove any residual Compound(s) and dried. The textile materials may then be stored until used.

In the pretreating operation of this invention, the free amine ends of the polyamide textile materials defined above reacts with the acylimidazole compounds in accordance with the following equation:

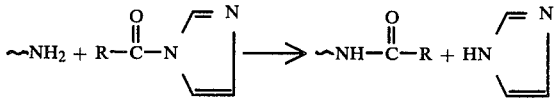

wherein R is as defined above.

Though not wishing to bound by theory, it is generally believed that the polyamide textile materials free amine ends serve as acid dye receptor cites and that, therefore, the acid dyeability of such textile materials will decrease as the number of amine free ends is likewise decreased.

It is a feature of the present invention that the imidazole by-product from the reaction of the polyamide textile material and the acylimidazole compound does not degrade the polyamide textile material.

Any suitable solvent for the individual Compound(s) used which has a boiling point of at least 50° C. is suitable for use in the process of this invention. Examples of suitable solvents include aromatic solvents such as toluene, xylene and benzene; ether solvents such as ethylene glycol dimethyl ether (glyme), dimethylene glycol dimethyl ether and trimethylene glycol dimethyl ether; ketone solvents such as acetone, 2-butanone, and 2-pentanone; ester solvents such as ethyl acetate and propylacetate; hydrocarbon solvents such as hexane and isooctane; aprotic solvents such as dimethyl-formamide (DMF) and heterocyclic solvents such as tetrahydrofuran (THF) and dioxane. Optionally, any combination of the above solvents may be used. The preferred solvents are DMF and toluene.

At least one Compound and the polyamide textile material are reacted at a temperature of from about 60° C. to about 140° C. for about 1 to about 300 minutes. It is understood that there does not have to be complete reaction between the polyamide material and the Compound in order for the polyamide material to show a significant decrease in its affinity for acid dyes.

It is understood that the Compound(s) and the polyamide textile material do not have to be reacted in solution form but in fact can be reacted in any manner that is convenient to the practitioner of the invention. For example, if the polyamide textile material is a tufted nylon carpet, the Compound(s) may be applied to the carpet in paste form, such as in combination with a suitable non-reactive thickener and, if desired, a solvent. The carpet may then be subjected to radiant heat in accordance with the reaction temperature and time parameters set forth above and then washed. Other methods of reacting the compounds with a variety of polyamide textile materials would be apparent to one skilled in the art.

It is understood that the practitioner of this invention can, by varying the reaction time and temperature, control the polyamide textile material's receptivity to acid dyes according to his individual needs. However, textile materials which are reacted at temperatures at or exceeding 140° C. for 60 minutes or longer may, while showing a marked decrease in their affinity for acid dyes, begin to show a corresponding drop in break strength due to the thermal degradation of the polyamide textile materials. The individual practitioner of this invention will, in any event, have to determine if such a drop in break strength is offset by the value of the fiber's decreased affinity for acid dyes.

In the process of the present invention from about 0.1 to about 5 grams, and preferably from about 0.5 to about 2.5 grams of Compound(s) are employed for every gram of polyamide textile material that is treated. Amounts of Compound far less than 0.001 g per gram of polyamide textile material may be employed and in fact will react with the polyamide textile material. However, the amount of reaction time needed in order to produce a significant decrease in the polyamide textile material's acid dyeability may be so long as to be commercially impractical, depending again on the individual needs of the practitioner.

The polyamide textile materials pretreated according to the process of the present invention may first, prior to such pretreating steps, be scoured, such as by being solvent and water washed at high temperatures, to thereby remove fiber dressing and spinning aids. This scouring and subsequent drying step is considered to be optional, and not essential, to the process of the present invention.

The Compounds utilized in the process of the present invention are available commercially or may be produced through methods well known to those skilled in the art, such as, for example, by the procedures outlined by H. Staab in Angewandte Chemie, 1, 351 (1962).

The term "alkyl" is used herein and in the appended claims to designate a saturated straight or branched chain radical containing from 1 to 10 carbon atoms such as, for example, methyl, ethyl, propyl, isopropyl, 2-methylpropyl, butyl, isobutyl, tert-butyl, pentyl, hexyl and the like. The terms "halo" and "halogen" are used herein and the appended claims to represent iodine, chlorine, fluorine and bromine. The term "cycloalkyl" is employed herein to designated radicals having from 3 to 10 carbon atoms such as, for example, cyclopropyl, cyclobutyl, cyclopentyl and cyclohexyl. The term "alkenyl" as employed in the present specification and claims designates an alkenyl radical containing from about 3 to about 6 carbon atoms, inclusive, such as, for example, propenyl, 2-methyl propenyl, butenyl, hexenyl, and the like which optionally may bear one or more halogen substituents. The term "alkynyl" as used herein and in the appended claims designates an alkynyl radical of from about 3 to about 6 carbon atoms, inclusive, such as, for example, propynyl, 2-methyl propynyl, butynyl, pentynyl, hexynyl, and the like which optionally may bear one or more halogen substituents. The term "aryl" is used herein and in the appended claims to designate phenyl and phenyl substituted with halogen, $NO_2$, and alkyl and alkyloxy groups having from 1 to 5 carbon atoms. The term "heterocyclic radical" is used herein and the appended claims to designate pyrole, furan, pyrazole, thiophene, imidazole, oxazole, thiazole, pyrazole, pyridine, pyrimidine, purine, pyrrolidine and isoquinoline.

EXAMPLES

The following examples illustrate the present invention and the manner by which it can be practiced but as such should not be construed as limitations upon the overall scope of the same.

EXAMPLE 1

In this example, bulk continuous nylon 66 yarn, available from E. I. DuPont de Nemours and Co. under the trade designation "DuPont 1325-88-0-746 Brt." were first scoured for use by washing 3 times for 10 minutes in trichlorotrifluoroethane followed by 3, 10 minutes water washes at 80° C. The yarn fibers were air dried and stored over $P_2O_5$ at high vacuum to remove excess water so that masses of dry fiber could be obtained for accuracy of measurement.

In the pretreating operation, one gram of the scoured nylon yarn was then reacted with 1.10 g of N-acetylimidazole in 160 ml of DMF for 30 minutes at 100° C. The fibers were then rinsed in toluene to remove any residual N-acetylimidazole and air dried.

The dye uptake measurements were done using CI Acid Red I, which is available from the Sandoz Corporation under the trade designation Sandolan Red E-2GL.

The dye bath was made by dissolving 3.0 g of CI Acid Red 1 in 4 liters of deionized water with sufficient formic acid to adjust the solution's pH, at 25° C., to 3.2. The yarn was then immersed in the dye solution for one hour at 100° C. to obtain equilibrum values of dye uptake. CI Acid Red 1 is very sensitive to the number of amine ends (acid dye receptor cites).

The grams of dye uptake per gram of fiber, which are set forth in TABLE 1, were determined by dissolving the dyed fiber in 88–90% reagent grade formic acid and measuring the absorbance of the resulting solution at 540 mm using a Cary Model 14 spectrophotometer. A Beer-Lambert law relationship was used to convert absorbance to grams of dye per gram of fiber.

In a comparative example, a one gram portion of nylon yarn similar to that used in Example 1 was scoured, washed and dried and then dyed according to the procedures set forth above. The dye uptake measurements, in terms of grams of dye per gram of fiber ($\times 10^3$), is set forth in TABLE 1 across from the heading marked "CONTROL."

EXAMPLES 2–6

The procedure of Example 1 was repeated exactly, except that the treatment time, i.e., the time the yarn was reacted with N-acetylimidazole, and the solvent, varied. The results of the Examples are set forth in TABLE 1.

TABLE 1

| Example | Treatment Time (min) | Solvent | Dye Uptake (grams of dye × $10^3$ grams of fiber) |
|---|---|---|---|
| 1 | 30 | DMF | 2.03 |
| 2 | 60 | DMF | 1.51 |
| 3 | 5 | Toluene | 1.98 |
| 4 | 15 | Toluene | 1.63 |
| 5 | 30 | Toluene | 1.58 |
| 6 | 60 | Toluene | 1.44 |
| Control | — | — | 13.3 |

The results, as set forth in TABLE 1, indicate that the acid dye uptake of nylon fibers which are pretreated according to the process of the invention is extensively decreased when compared to the control.

EXAMPLES 7–16

The procedure of Example 1 was repeated exactly, except that the Compound utilized, the Compound mass, and the treatment time changed. In all these examples, toluene was the solvent used. The treatment time was 60 minutes and the reaction temperature was 100° C. Table 2 sets forth the reaction parameters and results. In some examples the break strength of the fiber, in terms of maximum pounds pull, was measured after the dyeing operation. This data is also set forth in Table 2. The results of the comparative example, including the break strength which was also measured after the dyeing operation, are also set forth in Table 2.

TABLE 2

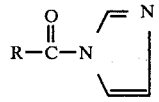

| Example | R | Mass Compound (grams) | Break Strength Maximum Lbs. Pull | Acid Dye Uptake grams of dye × $10^3$ (grams of fiber) |
|---|---|---|---|---|
| 7 | $CH_3$ | 1.10 | 9.3 | 1.44 |
| 8 | $CH_3CH_2$ | 1.24 | 8.9 | 2.31 |
| 9 | $CH_3(CH_2)_4$ | 2.58 | 9.3 | 2.59 |
| 10 | 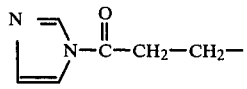 | 2.18 | * | 2.18 |
| 11 | $Cl_3C$ | 2.14 | * | 3.26 |
| 12 | 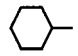 | 1.59 | 9.3 | 3.42 |
| 13 | 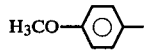 | 2.02 | 8.8 | 2.62 |
| 14 | 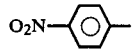 | 2.17 | 9.6 | 2.66 |
| 15 | 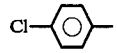 | 2.06 | 9.3 | 5.12 |
| 16 | 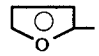 | 1.62 | 9.3 | 2.33 |
| Control | — | — | 8.8 | 13.3 |

*= break strength not measured

EXAMPLES 17–21

In these examples, the breaking strength of the nylon yarn was examined as a function of treatment time.

The procedure of Example 1 was followed, except that, in each example, 1.24 grams of N-propionylimidazole was utilized. The solvent was toluene and the reaction temperature was 110° C. The reaction time varied for each example. Table 3 sets forth the breaking strength for each example. The breaking strength of the comparative example is also set forth in Table 3.

TABLE 3

| Example | Reaction Time (min.) | Breaking Strength Max Lbs. Pull |
|---|---|---|
| 17 | 120 | 7.2 |
| 18 | 180 | 7.8 |
| 19 | 240 | 7.9 |
| 20 | 300 | 8.2 |
| 21 | 60 | 8.9 |
| Control | — | 8.8 |

The results of this table indicate that there is only a minimum drop in breaking strength in the yarn fiber even after the yarn fiber and N-propionylimidazole are reacted for five hours.

EXAMPLES 22–26

In these examples, the acid dye resistance of the treated yarn fibers were examined as a function of treatment time.

In these examples the procedures of Example 1 were generally followed. In each example, 1.10 grams of N-acetylimidazole were utilized in the reaction. The reaction solvent was toluene and the reaction temperature was 110° C.

The results of these examples are set forth in Table 4. The acid dye uptake of the comparative example is repeated for convenience in Table 4. For comparative purposes, the results from Examples 3 to 6 are also included in Table 4.

TABLE 4

| Example | Treatment Time (min.) | Acid Dye Uptake (gram of dye × $10^3$ gram of fiber) |
|---|---|---|
| 22 | 0.5 | 5.05 |
| 23 | 1 | 4.20 |
| 24 | 2 | 2.60 |
| 25 | 3 | 2.37 |
| 26 | 4 | 2.11 |
| 3 | 5 | 1.98 |
| 4 | 15 | 1.63 |
| 5 | 30 | 1.58 |
| 6 | 60 | 1.44 |
| Control | — | 13.3 |

What is claimed is:

1. A process for significantly decreasing the acid dye uptake of a polyamide article having free amine end groups which polyamide article is susceptible to acid dyes which comprises reacting the polyamide article with a compound of the formula:

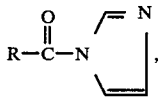

wherein R represents alkyl, haloalkyl, aryl, cycloalkyl, alkynyl, alkenyl, or a heterocyclic radical.

2. The process of claim 1 wherein the polyamide article and the compound are reacted in a solvent for the compound.

3. The process of claim 1 wherein the solvent is an aromatic solvent.

4. The process of claim 1 wherein the solvent is toluene.

5. The process of claim 2 wherein the solvent is dimethylformamide.

6. The process of claim 1 wherein the polyamide article is nylon 66.

7. The process of claim 1 wherein R is alkyl.

8. The process of claim 7 wherein R is $CH_3$.

9. The process of claim 7 wherein R is $CH_3CH_2$.

10. The process of claim 7 wherein R is $CH_3(CH_2)_4$.

11. The process of claim 1 wherein R is haloalkyl.

12. The process of claim 11 wherein R is $CCl_3$.

13. The process of claim 1 wherein R is aryl.

14. The process of claim 13 wherein R is

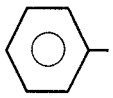

15. The process of claim 13 wherein R is

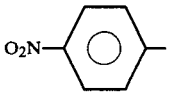

16. The process of claim 13 wherein R is

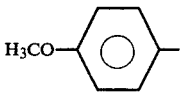

17. The process of claim 13 wherein R is

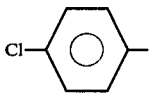

18. The process of claim 1 wherein R is a heterocyclic compound.

19. The process of claim 18 wherein R is

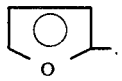

* * * * *